US011603695B2

(12) United States Patent
Vetter

(10) Patent No.: US 11,603,695 B2
(45) Date of Patent: Mar. 14, 2023

(54) METHOD FOR MOUNTING A DOOR DRIVE AND DOOR DRIVE

(71) Applicant: dormakaba Deutschland GmbH, Ennepetal (DE)

(72) Inventor: Matthias Vetter, Ennepetal (DE)

(73) Assignee: DORMAKABA DEUTSCHLAND GMBH, Ennepetal (DE)

( * ) Notice: Subject to any disclaimer, the term of this patent is extended or adjusted under 35 U.S.C. 154(b) by 273 days.

(21) Appl. No.: 16/669,476

(22) Filed: Oct. 30, 2019

(65) Prior Publication Data

US 2020/0224479 A1 Jul. 16, 2020

(30) Foreign Application Priority Data

Jan. 16, 2019 (EP) ..... 19152192

(51) Int. Cl.
*E05F 15/60* (2015.01)
*E05F 15/63* (2015.01)
*E05F 1/10* (2006.01)

(52) U.S. Cl.
CPC ..... *E05F 15/60* (2015.01); *E05F 1/10* (2013.01); *E05F 15/63* (2015.01); *E05Y 2900/132* (2013.01)

(58) Field of Classification Search
CPC . E05F 15/60; E05F 15/63; E05F 15/70; E05F 15/614; E05F 15/603; E05F 1/10; E05F 3/102; E05F 3/224; E05Y 2900/132; E05Y 2201/41; E05Y 2201/236; E05Y 2201/624; E05Y 2201/422; E05Y 2201/434; E05Y 2400/302; E05Y 2400/616
See application file for complete search history.

(56) References Cited

U.S. PATENT DOCUMENTS 5,687,507 A * 11/1997 Beran ..... E05F 15/70 49/340
6,067,753 A * 5/2000 Hebda ..... E05F 15/63 49/28
2006/0010771 A1* 1/2006 Houser ..... E05F 15/63 49/341
2006/0244271 A1* 11/2006 Hass ..... E05F 15/63 292/336.3

(Continued)

FOREIGN PATENT DOCUMENTS

CN 111441684 A 7/2020
DE 102013021132 A1 6/2015

(Continued)

*Primary Examiner* — Justin B Rephann
(74) *Attorney, Agent, or Firm* — Cantor Colburn LLP

(57) ABSTRACT

A method for mounting a door drive including a door actuator with a mounting section for the attachment to a counter-mounting section of a door, an attachment device for the attachment to a counter-attachment section of the door and a lever mechanism with a first end and with a second end, for the mobile support of the door actuator at the attachment device between a closing position and an opening position, where the attachment device is disposed at the first end of the lever mechanism and an axle assembly of the door actuator at a second end of the lever mechanism, and with an actuating unit of the door actuator for moving the axle assembly of the door actuator.

10 Claims, 3 Drawing Sheets

(56) References Cited

U.S. PATENT DOCUMENTS

| | | | | |
|---|---|---|---|---|
| 2007/0261309 | A1* | 11/2007 | Tommell | E05F 15/63 49/339 |
| 2012/0023824 | A1* | 2/2012 | Mason | E05F 1/1066 49/29 |
| 2016/0060941 | A1* | 3/2016 | Ingham | E05F 3/22 49/340 |
| 2018/0334845 | A1* | 11/2018 | Hass | E05F 3/224 |

FOREIGN PATENT DOCUMENTS

| | | | |
|---|---|---|---|
| DE | 102014115189 | A1 | 4/2016 |
| EP | 3309339 | A1 | 4/2018 |

* cited by examiner

METHOD FOR MOUNTING A DOOR DRIVE AND DOOR DRIVE

CROSS REFERENCE TO RELATED APPLICATION

This application is related to and claims the benefit of European Patent Application Number 19152192.1 filed on Jan. 16, 2019, the entire contents of which are incorporated herein by reference.

TECHNICAL FIELD

The present disclosure relates to a method for mounting a door drive, including a door actuator, an attachment device and a lever mechanism for the mobile support of the door actuator at the attachment device between a closing position and an opening position. An actuating unit of the door actuator is formed for moving an axle assembly of the door actuator. Furthermore, the disclosure relates to a door drive.

BACKGROUND

Drives and actuators are known for moving, for assisting a movement and/or for expanding the functions of a door, of a window and/or of another mobile opening closure. In a simple embodiment, for example, a door drive serves for assisting an opening and/or closing of a door and expands the scope of functions of the door, preferably with an opening position, which is arrestable. Usually, door drives consist of a device at the casing of the door, a device at the door leaf, and of a lever mechanism for the mobile support and connection of the device at the door casing to the device at the door leaf. Such a door drive uses an actuating unit for assisting the movement of the door, which unit charges the door with a force. The state-of-the-art knows for this purpose for example spring force devices and motor devices. Likewise, door drives are known, which are employable for doors with different hinge positions, for example on the right hand side or the left hand side at the lateral sections of a door. When mounting door drives, both with an actuating unit and with mounting door drives without an actuating unit, the lever mechanism needs to be connected and attached to the devices at the door casing and/or to the door leaf. For this purpose, the mobile elements, which are mainly rotatable or disposed in rails, of the devices at the door casing and/or at the door leaf must be correspondingly disposed and/or rotated, in order to allow for a connection and attachment to the lever mechanism. Such a positioning of the elements is prone to errors and can result in incorrect mounting and thus in expensive reworking. The state-of-the-art knows likewise a special tool for the alignment of pre-tensioned door drives, for example, which is necessary when mounting a corresponding door drive in order to allow for the mounting. The printed publication EP 3 309 339 A1 discloses an approach for solving the problem for the above-described topics with a drive for a leaf of a door or of a window with an exclusively mechanical securing of the mobile elements by means of arresting with a bolt, for an improved mounting of the lever mechanism.

BRIEF SUMMARY

The disclosure aims to overcome at least partially the above-described disadvantages of door drives. It is in particular, the disclosure provides a method for mounting a door drive and a door drive, in which the proneness to errors during mounting and the time required for mounting are reduced in a particularly simple and inexpensive manner.

In a first aspect of the disclosure, a method is provided for mounting a door drive including a door actuator with a mounting section for the attachment to a counter-mounting section of a door, an attachment device for the attachment to a counter-attachment section of the door and a lever mechanism, with a first end and with a second end, for the mobile support of the door actuator at the attachment device between a closing position and an opening position, wherein the attachment device is disposed at the first end of the lever mechanism and an axle assembly of the door actuator at a second end of the lever mechanism, and with an actuating unit of the door actuator for moving the axle assembly device of the door actuator, wherein the method is characterized by the following steps:

- attaching the attachment device to a counter-attachment section of the door,
- mounting the mounting section of the door actuator to a counter-mounting section of the door,
- moving the axle assembly of the door actuator into at least one first lever mounting position by means of the actuating unit,
- disposing and affixing the first end of the lever mechanism to the attachment device,
- disposing and affixing the second end of the lever mechanism to the axle assembly of the door actuator.

A mounting section of a door actuator serves for mounting to a counter-mounting section of a door. An attachment section serves for the attachment to a counter-attachment section of a door. Both the mounting section and the attachment section can be disposed at and attached respectively to the door leaf or to the door casing. Within the scope of the disclosure, as an alternative, likewise mounting the mounting section or the attachment section to a wall, to a ceiling and/or to a structural element is conceivable and possible, which is not part of the door, instead of to the door casing. For example for this purpose, the mounting section and the attachment section are provided with holes for attachment means, such as screws. Likewise, the mounting section and the attachment section can be installed magnetically to the counter-mounting section, respectively to the counter-attachment section, or can be glued to the latter. Likewise conceivable and possible are clamping connections and further attachment options between the mounting section and the attachment section to the respective counter-section of the door, respectively of the wall. Within the scope of the disclosure, a door actuator is a device for developing a force in at least one area of movement or partial area of movement of the door. For this purpose, the door actuator of the door drive includes an axle assembly. The axle assembly is supported to be mobile, preferably rotatable. Likewise, the axle assembly can be formed as a rail structure for moving along an axis, or essentially along an axis. Essentially along an axis means that small lateral deviations of the movement from the axis are tolerable within the scope of the disclosure as well. The movement of the axle assembly allows for a movement of the door leaf between at least one opening position and at least one closing position of the door, by way of attaching the lever mechanism with a first end of the lever mechanism to the attachment device and with a second end of the lever mechanism to the axle assembly of the door actuator. The attachment of the lever mechanism to the attachment device and to the axle assembly can be formed at least in portions to be torque-proof and/or be at least in portions rotatably and/or be supported in a mobile manner. The actuating unit develops the force for moving the axle assembly of the door actuator for example by means of a spring, a cylinder, a motor and/or another device. The actuating unit can develop the force for moving the axle assembly directly at the axle assembly or spaced apart from the latter, for example at the attachment device and/or at the lever mechanism. Such a configured method allows for mounting a door drive, in which the proneness to errors during mounting and the time required for mounting are reduced, in a particularly simple and inexpensive manner.

In this case preferably with an inventive method, it can be intended the actuating unit be formed as a motor unit and the movement of the axle assembly of the door actuator be performed by the motor unit. A motor unit for moving the axle assembly of the door actuator is an advantageous further development of the inventive method, because a motor unit has a constant, in particular continuous development of force for moving the door leaf between at least one opening position and at least one closing position. Furthermore, a motor unit can be extensively controlled and can be stopped in a defined manner at any point in time, respectively in any area of the movement. A motor unit can influence and control in a defined manner the speed of the movement so that the motor unit allows for an accelerated movement of the axle assembly and a decelerated movement of the axle assembly.

Moreover, in an inventive method, it can be intended the actuating unit be formed as a tensioning force unit and the movement of the axle assembly of the door actuator be performed by the tensioning force unit. A tensioning force unit allows for a particularly inexpensive solution of developing the force for the movement of the axle assembly. Particularly advantageously, a tensioning force unit develops a force for the movement of a door between an opening position and a closing position, because for example a receding force is enabled with increasing relaxation of the tensioning force unit, and consequently, towards the end of a movement between an opening position and a closing position, the door is charged to a lesser degree with a force and thus a loud closing or jerked opening of the door and/or of the window are/is prevented. Likewise, simple structural means can influence the tensioning force curve of a tensioning force unit and thus advantageously influence the opening, respectively the closing movement of a door and/or of a window. Additionally or alternatively to a force of a motor unit for the movement of the axle assembly, a tensioning force of a tensioning force unit can be developed.

Particularly preferred, it can be intended in an inventive method that the actuating unit move the axle assembly of the door actuator into a first lever mounting position, when a first axle lever of the axle assembly is being disposed and affixed and the actuating unit move the axle assembly of the door actuator into a second lever mounting position, when a second axle lever of the axle assembly is being disposed and affixed. For example, in doors, windows and further mobile opening closures, positioning the articulations can determine the opening movement, respectively the closing movement. Essentially for example, a right-opening door represents a mirroring in a vertical plane of a left-opening door. The door drive needs to be tuned to the movement of the door. With the intention to reduce cost and to optimize manufacturing, most of the time door drives are formed for driving both right-opening doors and left-opening doors, for example. However, different axle levers and/or a different attachment of the axle levers at the axle assembly are required for the different movements. Therefore, a first axle lever and a second axle lever can be formed differently or equally. The first axle lever and the second axle lever can be a structural component of the axle assembly or of the lever mechanism. In particular in a rotatable axle assembly, the lever mounting positions of the axle assembly can be disposed between 0° and 180°, particularly preferred at 0°, 90° and/or at 115°. For an inexpensive manufacturing and a simple mounting at low proneness to errors, advantageously, the lever mounting positions can be located opposite each other, namely spaced apart by 180°.

As a consequence, an inventive method allows for mounting two door drives, which are identical in structural design, for two different door movements of two doors, in that a first axle lever is disposed at and affixed to the axle assembly in a first lever mounting position, for example, and a second axle lever is disposed at and affixed to the other axle assembly in a second lever mounting position.

An inventive method can be further developed as well in that the actuating unit moves the axle assembly of the door actuator into a first lever mounting position or a second lever mounting position, based on a recognition unit of the door drive recognizing the first axle lever or the second axle lever. An inventive method is particularly advantageous, if the selection of the lever mounting position is made directly based on a recognized axle lever. Thereby, the proneness to errors during mounting is further reduced and advantageously, the mounting is accelerated. A recognition unit can at least partially automate the recognition and/or the recognition can at least partially be manually performed.

Furthermore, according to a further development of an inventive method, it can be intended that the actuating unit move the axle assembly of the door actuator into a first lever mounting position or into a second lever mounting position, based on a switch position of a switch of the door drive. A switch for adjusting, respectively for selecting the lever mounting position is an inexpensive possibility for reducing the proneness to errors when mounting a door drive. In particular, a switch is a manual switch, which an operator can actuate. Particularly advantageously, a switch is formed as a rotary switch with indications of angles. With such a switch, an operator can select the desired position of the axle assembly in a lever mounting position and an actuating unit moves the axle assembly correspondingly into the selected lever mounting position. Consequently, a faulty positioning of the axle assembly is prevented when mounting the door drive.

Moreover preferably, an inventive method can be further developed in that the door drive includes a building power mains connection and/or an energy accumulator for the power supply of the door actuator, in particular of the motor unit of the door actuator. A door drive, in particular a door drive with motor, can require a power supply for performing the movement, for an illumination device and/or for further devices of the door drive. Advantageously, it is intended therefore to allow for the energy supply by means of an energy accumulator and/or by means of a building power mains connection.

Particularly preferred, an inventive method can be defined in that the door drive includes a computing unit with a memory unit for controlling the actuating unit, wherein the memory unit is designed for storing at least one lever mounting position. Advantageously, a computing unit can extensively control an actuating unit. Advantageously, a computing unit expands the scope of functions of a door drive and can be controlled and operated in a wire-bound and/or wireless manner. Preferably, the computing unit is connected by wires to the actuating unit and can move the axle assembly into the different lever mounting positions via the actuating unit. Such a further developed method allows for controlling the movement of the axle assembly by means of a computing unit. For example, with such simple means and at very little time expense, a plurality of door drives can be prepared for their mounting purpose, in that the axle assemblies are already moved to the correct lever mounting positions. Likewise, a remote adjustment of the lever mounting positions is enabled. Advantageously, a memory unit expands the scope of functions of the computing unit and allows for a storage of at least one lever mounting position, which the computing unit, respectively the axle assembly can approach.

According to a second aspect of the disclosure, a door drive is provided including a door actuator with a mounting section for attachment to a counter-mounting section of a door, an attachment device for attaching to a counter-attachment section of the door and a lever mechanism, with a first end and with a second end, for the mobile support of the door actuator at the attachment device between a closing position and an opening position, wherein the attachment device is disposed at the first end of the lever mechanism and an axle assembly of the door actuator at a second end of the lever mechanism, and with an actuating unit for moving the axle assembly. As a door actuator according to the second aspect is formed for the use in the method according to the first aspect, a door actuator according to the second aspect of the disclosure has the same advantages as they have been described with regard to the method according to the first aspect of the disclosure and vice versa. In an inventive door drive, it can be likewise intended that the actuating unit be formed as a motor unit and/or as a tensioning force unit. A motor unit for moving the axle assembly of the door actuator is an advantageous further development of the inventive door drive, because a motor unit has a constant, in particular continuous development of force for the movement of the door leaf between at least one opening position and at least one closing position. A motor unit can be extensively controlled and can be stopped in a defined manner at any point in time, respectively at any part of the movement. A motor unit can influence and control in a defined manner the speed of the movement so that the motor unit allows for an accelerated movement of the axle assembly and for a decelerated movement of the axle assembly. A tensioning force unit allows for a particularly inexpensive solution of developing the force for the movement of the axle assembly.

In this case, preferably, in an inventive door drive, it can be intended the axle assembly be mobile at least from a closing position to an opening position via at least one lever mounting position. An axle assembly can be moved by a rotary movement and/or a movement along an axis and/or by means of another movement between an opening position and a closing position. According to the further development of the inventive door drive, at least one lever mounting position is disposed between the closing position and the opening position. Preferably, at least two lever mounting positions are disposed between the closing position and the opening position.

Furthermore, according to a further development of the inventive door drive, it can be intended the door actuator include at least one abutment for the movement of the axle assembly and/or of the lever mechanism at least at one of the closing position, the lever mounting position and/or the opening position. Beyond the actuating unit influencing the sequence of movements, additionally at least one abutment can influence the movement of the axle assembly. An abutment delimits or stops the movement of the axle assembly at least at one point of the sequence of movements. Stopping the sequence of movements can be temporarily or permanently, namely the movement can be briefly discontinued at the point at which the abutment stops the movement, in order to continue the movement in the same direction, for example after having overcome a resistance of the abutment. Overcoming the resistance, can require an intervention of a user or can be performed automatically by the door actuator. Within the scope of the disclosure, briefly means a couple of seconds up to half a minute.

At least one abutment is an advantageous further development of the inventive door drive, because the at least one abutment represents an inexpensive possibility for influencing the sequence of movements of the door drive.

Also, an inventive door drive can be further developed in that the actuating unit moves the axle assembly of the door actuator into a first lever mounting position and into at least one second lever mounting position. An inventive door drive allows for mounting two door drives, which are identical in structural design, for two different door movements of two doors, in that a first axle lever is disposed at and affixed to the axle assembly in a first lever mounting position, for example, and a second axle lever is disposed at and affixed to the other axle assembly in a second lever mounting position.

Furthermore, according to a further development of an inventive door actuator, it can be intended the actuating unit moves the axle assembly of the door actuator into a first lever mounting position or into a second lever mounting position, based on a recognition unit of the door drive recognizing the first axle lever or the second axle lever. An inventive door drive is particularly advantageous, if the selection of the lever mounting position is made directly based on a recognized axle lever. Thereby, the proneness to errors during mounting is further reduced and the mounting is advantageously accelerated. A recognition unit can at least partially automate the recognition and/or the recognition can at least partially be manually performed.

Moreover preferably, an inventive door drive can be further developed in that the actuating unit moves the axle assembly of the door actuator into a first lever mounting position or into a second lever mounting position, based on a switch position of a manual switch of the door drive. A switch for adjusting, respectively for selecting the lever mounting position is an inexpensive possibility for reducing the proneness to errors when mounting a door drive. In particular, a switch is a manual switch, which an operator can actuate. Particularly advantageously, a switch is formed as a rotary switch with indications of angles. With such a switch, an operator can select the desired position of the axle assembly in a lever mounting position and an actuating unit moves the axle assembly correspondingly into the selected lever mounting position. Consequently, a faulty positioning of the axle assembly is prevented when mounting the door drive.

Particularly preferred, an inventive door drive can be configured in that the door drive includes a computing unit of the door drive with a memory unit for controlling the actuating unit, wherein the memory unit is designed for storing of lever mounting positions. Advantageously, a computing unit expands the scope of functions of a door drive and can be controlled and operated in a wire-bound and/or wireless manner. Preferably, the computing unit is connected to the actuating unit by wires and the actuating unit can move the axle assembly into the different lever mounting positions. Such a further developed door drive allows a control for the movement of the axle assembly by means of a computing unit. For example, with such simple means and at very little time expense, a plurality of door drives can be prepared for the mounting purpose thereof, in that the axle assemblies are already moved to the correct lever mounting position. Likewise, a remote adjustment of the lever mounting positions is enabled. Advantageously, a memory unit expands the scope of functions of the computing unit and allows for a storage of at least one lever mounting position, which the computing unit, respectively the axle assembly can approach.

BRIEF DESCRIPTION OF THE DRAWINGS

An inventive method as well as an inventive door drive as well as the further advantages thereof will be explained in more detail based on the drawings. In the FIGS. 1 to 3, elements having the same function and the same effect are respectively identified by the same reference numerals. It is diagrammatically shown in.

DETAILED DESCRIPTION

Figure 1:
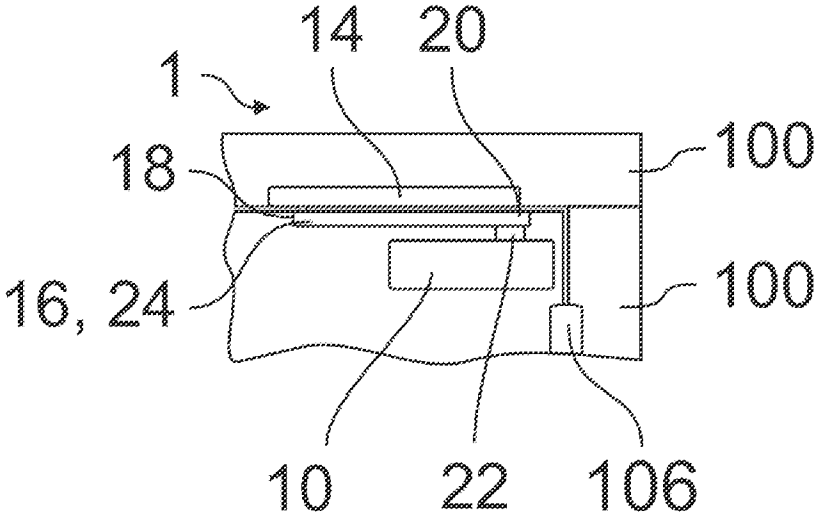
FIG. 1 a lateral view and a frontal view of a door drive with a door actuator with a mounting section at a counter-mounting section at a leaf of a door, an attachment device at a counter-attachment section at a casing of the door and a lever mechanism for the mobile support of the door actuator at the attachment device between a closing position and an opening position, FIG. 2 a lateral view and a frontal view of a door drive with a door actuator with a mounting section at a counter-mounting section at a casing of a door, an attachment device at a counter-attachment section at a leaf of the door and a lever mechanism for the mobile support of the door actuator at the attachment device between a closing position and an opening position, FIG. 3 a frontal view of a door drive with a door actuator with a recognition unit, with a switch, with a computing unit, with a memory unit and with an energy accumulator, an attachment device and with a lever mechanism for the mobile support of the door actuator at the attachment device between a closing position and an opening position.
Figure 1:
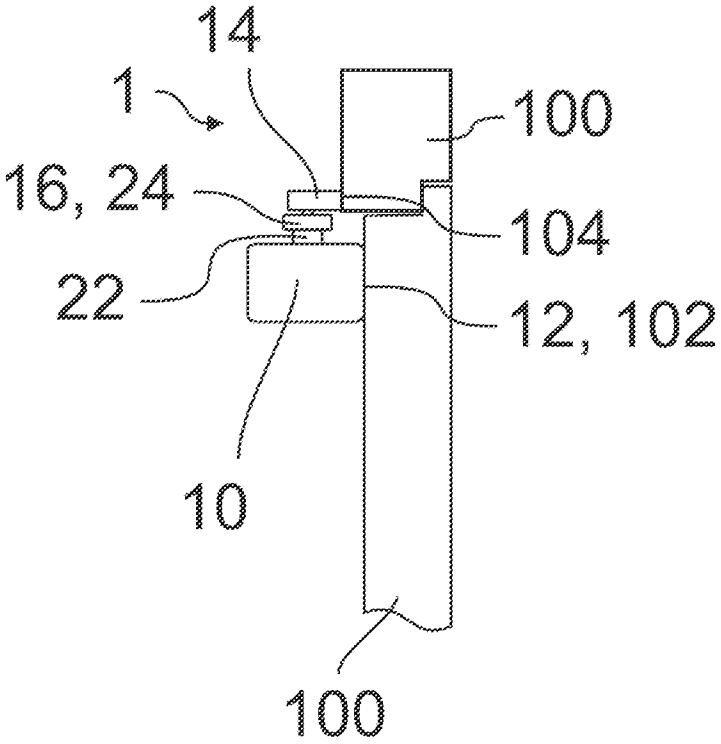

FIG. 1 shows a lateral view and a frontal view of a door drive 1 with a door actuator 10, an attachment device 14 and a lever mechanism 16 for the mobile support of the door actuator 10 at the attachment device 14 between a closing position SP (not shown) and an opening position OP (not shown). The attachment device 14 is attached to a counter-attachment section 104 of the casing of a door 100. The door actuator 10 includes a mounting section 12, which is attached to a counter-mounting section 102 at the leaf of the door. A first end 18 of the lever mechanism 16 is disposed at and affixed to the attachment device 14. A second end 20 of the lever mechanism 16 is disposed at and affixed to the axle assembly 22 of the door actuator 10. The door 100 includes at least one door hinge 106 on the right side and consequently it is a right-opening door 100 in the sense of the disclosure. A first axle lever 24 of the lever mechanism 16 is mounted to the axle assembly 22 in a first lever mounting position 30 (not shown). In this embodiment, the attachment device 14 is embodied as a rail with lateral extension in the frontal view. Such a configured door drive 1 allows for reducing a proneness to errors during mounting and for reducing the time required for mounting in a particularly simple and inexpensive manner.

Figure 2:
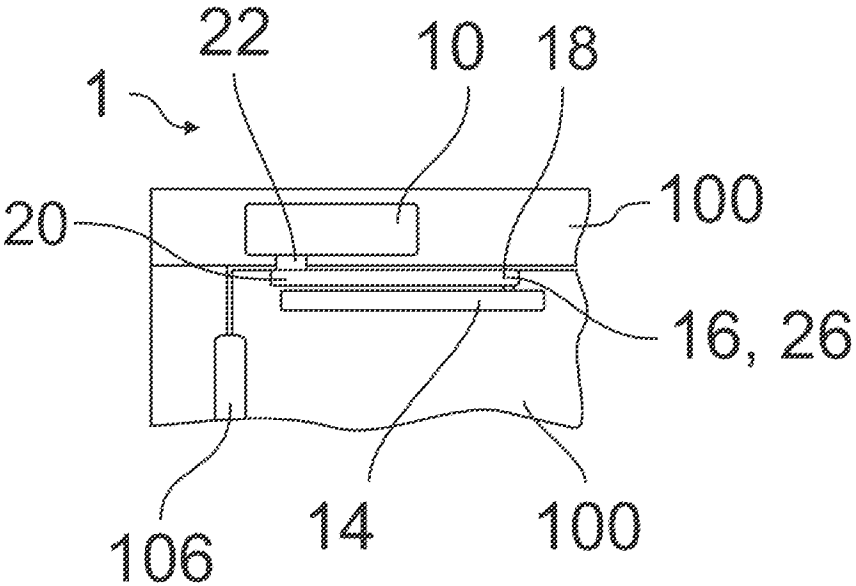
Figure 2:
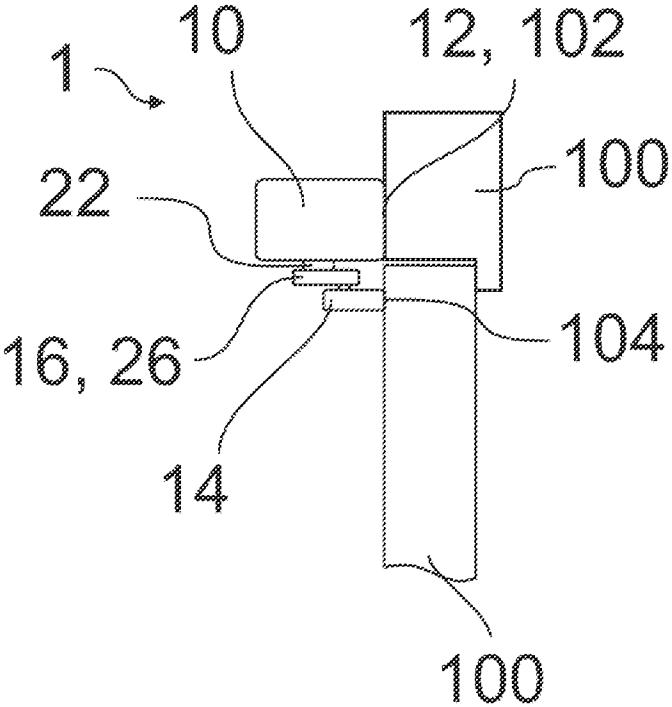

FIG. 2 shows a lateral view and a frontal view of a door drive 1 with a door actuator 10, an attachment device 14 and a lever mechanism 16 for the mobile support of the door actuator 10 at an attachment device 14 between a closing position SP (not shown) and an opening position OP (not shown). The attachment device 14 is attached to a counter-attachment section 104 at the leaf of a door 100. The door actuator 10 includes a mounting section 12, which is attached to a counter-mounting section 102 at the casing of the door. A first end 18 of the lever mechanism 16 is disposed at and affixed, respectively mounted to the attachment device 14. A second end 20 of the lever mechanism 16 is disposed at and affixed, respectively mounted to the axle assembly 22 of the door actuator 10. The door 100 includes at least one door hinge 106 on the left side and consequently it is a left-opening door 100 in the sense of the disclosure. A second axle lever 26 of the lever mechanism 16 is mounted to the axle assembly 22 in a second lever mounting position 32 (not shown). Such a configured door drive 1 allows for reducing a proneness to errors during mounting and for reducing the time required for mounting in a particularly simple and inexpensive manner. The FIGS. 1 and 2 clearly show how two structurally identically designed door drives 1 of the disclosure can be employed for two different door movements of two doors 100, in that for example, a first axle lever 24 is mounted to the axle assembly 22 in a first lever mounting position 30 (not shown) (refer to FIG. 1) and for example a second axle lever 26 is mounted to the other axle assembly 22 in a second lever mounting position 32 (not shown) (refer to FIG. 2). The FIGS. 1 and 2 likewise show that the attachment unit 14 and the door actuator 10 can be respectively mounted both to the leaf of the door 100 and to the casing of the door 100, respectively to an adjoining wall and/or ceiling.

Figure 3:
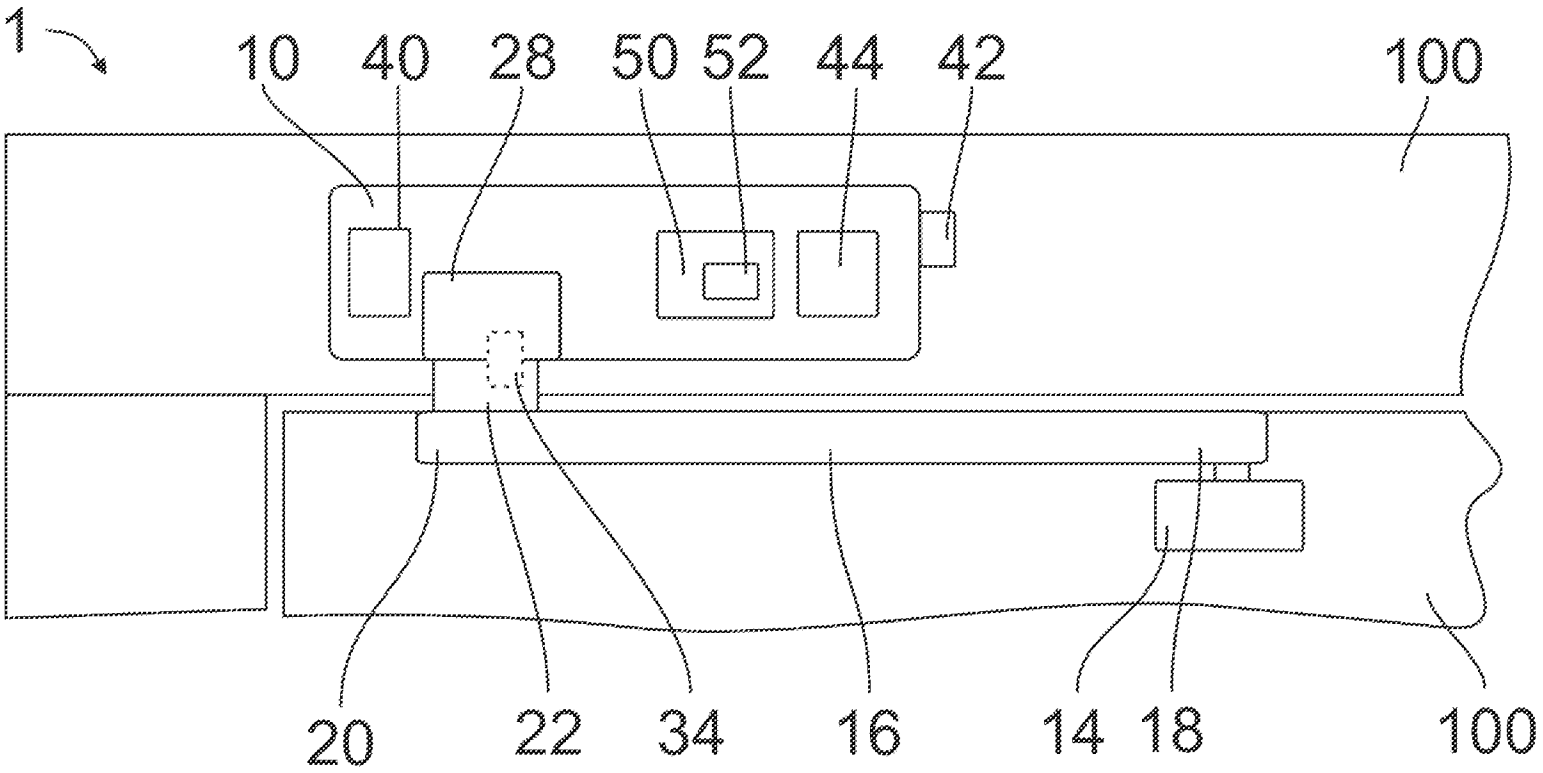

FIG. 3 shows a frontal view of a door drive 1 with a door actuator 10, an attachment device 14 and a lever mechanism 16 for the mobile support of the door actuator 10 at the attachment device 14 between a closing position SP (not shown) and an opening position OP (not shown). The door actuator 10 includes an actuating unit 28, a recognition unit 40, a switch 43, a computing unit 50 with a memory unit 52 and an energy accumulator 44. An abutment 34 delimits and/or influences the movement of the axle assembly 22 of the door actuator 10. The actuating unit 28 develops the force for moving the axle assembly 22 of the door actuator 10 for example by means of a spring, a cylinder, a motor and/or another device. In the embodiment of the disclosure shown, the actuating unit 28 develops the force for moving the axle assembly 22 directly at the axle assembly 22. In this embodiment, the attachment device 14 is embodied as a bracket with considerably lesser lateral extension in the frontal view than compared to the FIGS. 1 and 2. Such a configured door drive 1 allows for mounting the door drive 1 in a particularly simple and inexpensive manner with a low proneness to errors during mounting and at reduced the time required for mounting.

In addition to the illustrated exemplary embodiments, the disclosure allows for further design principles. This means, the disclosure is not considered to be limited to the exemplary embodiments, which are explained based on the Figures.

The invention claimed is:

1. A method for mounting a door drive including a door actuator with a mounting section for the attachment to a counter-mounting section of a door, an attachment device for the attachment to a counter-attachment section of the door and a lever mechanism with a first end and with a second end, for the mobile support of the door actuator at the attachment device between a closing position and an opening position, wherein the attachment device is disposed at the first end of the lever mechanism and an axle assembly of the door actuator at the second end of the lever mechanism, and with an actuating unit of the door actuator for moving the axle assembly of the door actuator, the method comprising:

attaching the attachment device to the counter-attachment section of the door, mounting the mounting section of the door actuator to the counter-mounting section of the door, moving the axle assembly of the door actuator into at least one first lever mounting position by means of the actuating unit, disposing and affixing the first end of the lever mechanism to the attachment device, disposing and affixing the second end of the lever mechanism to the axle assembly of the door actuator, wherein the actuating unit is formed as a motor unit, and the motor unit performs the movement of the axle assembly of the door actuator;

wherein the axle assembly has a first axle lever and a second axle lever and the actuating unit moves the axle assembly of the door actuator into the first lever mounting position, when the first axle lever is being disposed and affixed to the axle assembly and the actuating unit moves the axle assembly of the door actuator into at least one second lever mounting position, when the second axle lever is being disposed and affixed to the axle assembly.

2. The method according to claim 1, wherein the actuating unit moves the axle assembly of the door actuator into the first lever mounting position or into a second lever mounting position, based on a recognition unit of the door drive recognizing the first axle lever or the second axle lever.

3. The method according to claim 1, wherein the actuating unit moves the axle assembly of the door actuator into the first lever mounting position or into a second lever mounting position, based on a switch position of a switch of the door drive.

4. The method according to claim 1, wherein the door drive includes a building power mains connection and/or an energy accumulator for the power supply for the door actuator.

5. The method according to claim 1, wherein the door drive includes a computing unit with a memory unit for controlling the actuating unit, wherein the memory unit is formed for storing the at least one first lever mounting position and at least one second lever mounting position.

6. A door drive including a door actuator with a mounting section for the attachment to a counter-mounting section of a door, an attachment device for the attachment to a counter-attachment section of the door and a lever mechanism with a first end and with a second end for the mobile support of the door actuator at the attachment device between a closing position and an opening position, wherein the attachment device is disposed at the first end of the lever mechanism, and an axle assembly of the door actuator is disposed at the second end of the lever mechanism with an actuating unit for moving the axle assembly, wherein the actuating unit is formed as a motor unit, and the motor unit performs the movement of the axle assembly of the door actuator;

wherein the actuating unit is able to move the axle assembly of the door actuator into at least one first lever mounting position and into at least one second lever mounting position, wherein the actuating unit is able to move the axle assembly of the door actuator into a first lever mounting position or into a second lever mounting position, based on a recognition unit of the door drive recognizing a first axle lever or a second axle lever of the axle assembly.

7. The door drive according to claim 6, wherein the axle assembly is mobile at least from the closing position into the opening position via at least one lever mounting position.

8. The door drive according to claim 6, wherein the door actuator includes at least one abutment for the movement of the axle assembly and the lever mechanism to at least at one of the closing position, the first lever mounting position, the second lever mounting position, and the opening position.

9. The door drive according to claim 6, wherein the actuating unit is able to move the axle assembly of the door actuator into the first lever mounting position or into the second lever mounting position, based on a switch position of a switch of the door drive.

10. The door drive according to claim 6, wherein a computing unit of the door drive is formed with a memory unit for controlling the actuating unit, wherein the memory unit is formed for storing at least two lever mounting positions.

* * * * *